US005983522A

United States Patent [19]

Adler

[11] Patent Number: 5,983,522

[45] Date of Patent: Nov. 16, 1999

[54] DRYING AND PRESSING MACHINE WITH A FLOW SPUN PRESSING CYLINDER

[75] Inventor: Michel Adler, Villery, France

[73] Assignee: Electrolux Systemes de Blanchisserie, Rosieres, France

[21] Appl. No.: 09/009,227

[22] Filed: Jan. 20, 1998

[30] Foreign Application Priority Data

Jan. 23, 1997 [FR] France ..... 97 00669

[51] Int. Cl.[6] ..... F26B 7/00

[52] U.S. Cl. ..... 34/382; 34/385; 34/400; 34/425; 34/111; 34/602

[58] Field of Search ..... 34/108, 110, 111, 34/113, 124, 127, 132, 595, 602, 603, 382, 385, 400, 425; 100/153, 313; 38/44, 56, 66, 143; 19/44; 162/358.5, 360.3; 72/199, 85

[56] References Cited

U.S. PATENT DOCUMENTS 1,819,534 8/1931 Akerlow .
4,089,738 5/1978 Kankaanpaa ..... 162/206
4,758,310 7/1988 Miller ..... 34/116 X
4,787,157 11/1988 Ferrage et al. ..... 38/56

FOREIGN PATENT DOCUMENTS 711 861 5/1996 European Pat. Off. .
2698388 5/1994 France .

OTHER PUBLICATIONS

Patent Abstracts of Japan, vol. 011, No. 255 (M–617), Aug. 19, 1987 & JP 62 061734 A (Dasukin:KK), Mar. 18, 1987.
Patent Abstracts of Japan, vol. 008, No. 158 (M–311), Jul. 21, 1984 & JP 59 054425 A (Toshiba Kikai KK), Mar. 29, 1984.

*Primary Examiner*—Henry Bennett
*Assistant Examiner*—Steve Gravini
*Attorney, Agent, or Firm*—Pearne, Gordon, McCoy & Granger LLP

[57] ABSTRACT

In a drying and pressing machine that includes a pressing cylinder, a flow spun stainless steel pressing cylinder is used, produced in one piece and without welding. This cylinder (10) has a reduced thickness. It rests on rollers (10) that comprise glass fiber reinforcement and a resin matrix. Each roller (12) is mounted on a fixed spindle (24) using a ball bearing (26).

7 Claims, 1 Drawing Sheet

DRYING AND PRESSING MACHINE WITH A FLOW SPUN PRESSING CYLINDER

BACKGROUND OF THE INVENTION

This invention relates to a drying-pressing machine of the type in which the washing to be pressed makes its way between a rotating, internally heated, pressing cylinder and endless belts which are in contact with the external surface of the cylinder over the greater part of its circumference.

Such drying-pressing machines are used commonly in establishments within which a large quantity of washing is processed on a daily basis. By way of examples which are in no way limitative one could mention hospitals, clinics, retirement homes, restaurants etc.

In drying-pressing machines fitted with a rotating, internally heated pressing cylinder, the pressing cylinder is constituted by a metal sheet the extremities of which rest on rollers supported on the machine chassis. In large size machines, the diameter of the pressing cylinder goes up to about 600 mm, for a length of 4 or 5 meters.

Taking into account the large diameter of the pressing cylinder which is fitted to drying-pressing machines of this type, this cylinder is normally fabricated from a flat sheet which is bent and whose adjacent edges are finally welded along a generator.

In existing pressing cylinders fabricated according to this technique, the weld which extends over the whole length of the cylinder constitutes an area of stress, causing deformation of the cylinder under the effect of the variations in temperature which arise when the machine is being used. In order to limit these deformations, one is driven to use steel, in the form of relatively thick sheet (about 4 to 6 mm depending on the diameter).

Furthermore, the humid environment in which the pressing cylinder is permanently to be found, poses problems of oxidation for the ordinary steel commonly used, notably when the machine is in a saline environment as is the case on the coast. This corrosion phenomenon is even more difficult to control when the temperatures to which the cylinder is heated do not allow it to be protected, for example, by a resin, when the machine is in operation.

Taking account of the large dimensions of the pressing cylinder, the relatively thick nature of the sheet steel in which it is formed gives the cylinder a large mass, which is not without consequences for the sizing of the structures of the machine that are used to support this cylinder.

Hence the high mass of the pressing cylinder requires that metal rollers are used, generally cast iron or steel, in order to support the cylinder at each of its extremities. These metal rollers, which must be of relatively large size, are fixed onto spindles which are rotatably mounted, using ball bearings, in parts of the chassis of the machine situated beyond the extremities of the cylinder. In certain cases, the rollers are mounted on cantilevers which requires each to be supported by means of two ball bearings of large size. In other cases, the rollers are mounted on common spindles which extend over the entire length of the machine and which also lead to the use of large size ball bearings. In all cases, this layout, in itself relatively expensive, requires in addition that the chassis is provided with a reinforced structure, capable of bearing the high forces which are applied to it. These cumulative characteristics are therefore translated into extra costs which are not negligible for drying-pressing machines designed in this way.

In addition the metal to metal contact between the steel of the pressing cylinder and the steel or the cast iron of the rollers translates itself at the same time into both relatively unpleasant noise for the user and premature wear of the rollers and the end areas of the cylinder in contact with these rollers.

The high mass of the pressing cylinder of current machines also has the consequence of high thermal inertia, which is detrimental to good matching of the machine to the nature of the washing being pressed.

SUMMARY OF THE INVENTION

The precise object of the invention is a drying-pressing machine, the pressing cylinder of which is produced in a totally original way, which allows the elimination of the above-mentioned disadvantages of present machines and which notably has less thermal inertia, deforms in a perfectly homogeneous manner under the effect of temperature variations and has a reduced mass that permits the use of lighter and less costly techniques for supporting the cylinder.

Conforming to the invention, this result is achieved by means of a drying-pressing machine, characterized by the fact that it includes a rotating pressing cylinder made of flow spun stainless steel, produced in one piece and without welding.

The use of stainless steel, and resorting to the technique of flow spinning in order to manufacture the pressing cylinder, permits the elimination of all localized areas of stress in the cylinder, enables it to have reduced thickness (for example, about 2.3 mm) and allows the machine to be used in any environment, even a saline one, without the risk of oxidation of the cylinder and without it being necessary to protect it in any manner whatsoever.

The thickness of the pressing cylinder depends, in part, on its external diameter. Hence, the reduction in the thickness of the stainless steel sheet forming the cylinder, in relation to an existing cylinder is such that the ratio between the thickness of the cylinder and its external diameter is between $1/180$ and $1/280$ depending on the diameter.

Preferably, the pressing cylinder has circumferential grooves on its external surface. This characteristic obtained naturally by the technique of flow spinning, if no subsequent machining is carried out, allows the thermal exchange surface to be increased, which reduces still more the thermal inertia of the machine.

In one preferred embodiment of the invention, the pressing cylinder rests on cambered rollers made from a non-metallic material, such as a composite material that includes reinforcing glass fibers in a matrix of resin. This characteristic, made possible by the appreciable reduction in the mass of the cylinder achieved thanks to the invention, allows operational noise to be very greatly reduced, as well as related wear on the cylinder and on the rollers.

Advantageously, each of the cambered rollers is mounted on a fixed spindle using at least one ball bearing. This direct mounting of the rollers on fixed spindles allows an appreciable reduction to be made in the size of the bearings used and as a consequence, a reduction in their cost. The part of the chassis supporting the rollers can, in addition, be made lighter compared with existing drying-pressing machines.

BRIEF DESCRIPTION OF THE DRAWINGS

By way of a non-limitative example, one preferred embodiment of the invention will now be described making reference to the appended drawings in which.

DETAILED DESCRIPTION OF THE PREFERRED EMBODIMENTS

Figure 1:
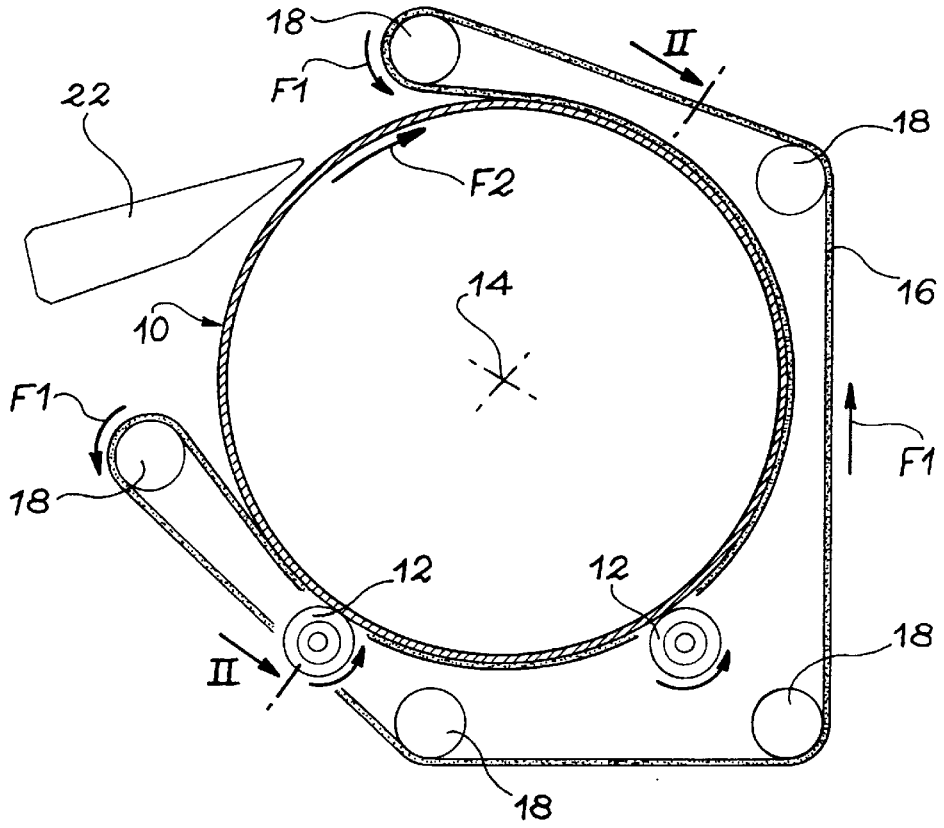
FIG. 1 is a cross section view illustrating in a very diagrammatic way, a drying-pressing machine conforming to the invention.

In FIG. 1, a drying-pressing machine conforming to the invention has been shown in very diagrammatic fashion, deliberately leaving out all the elements the representation of which would not contribute to good understanding of the invention.

The drying-pressing machine according to the invention includes a rotating pressing cylinder 10 the original characteristics of which will be described below. The pressing cylinder 10 rests on four cambered rollers 12, in such a way that its axis 14 is horizontal. More precisely, each of the extremities of the cylinder 10 rests on two cambered rollers 12 whose geometrically horizontal axes are aligned two by two and parallel to the axis 14. The cambered rollers 12 are free to turn about their geometric axes, in such a way that the pressing cylinder 10 can itself turn freely about its geometric axis 14.

The drying-pressing machine comprises, in addition, endless belts 16 which are mounted on rollers 18, whose geometric axes are all parallel to the geometric axis 14 of the cylinder 10. The endless belts 16 are in contact with the external surface of the pressing cylinder 10, over its entire length and over the greater part of its circumference.

Figure 2:
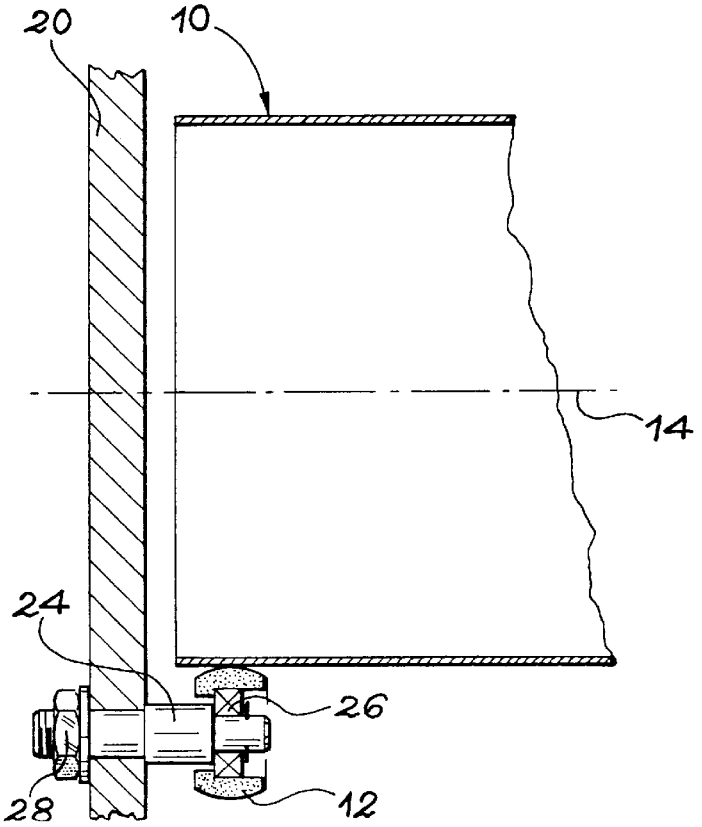
FIG. 2 is a larger scale, longitudinal, section view along the line II—II of FIG. 1.

Both the rollers 16 and the cambered rollers 12 are mounted on a chassis 20, only a small part of which appears in FIG. 2. All the rollers 18 are mounted to be freely rotating on this chassis, with the exception of one of them, which is rotatably driven by a geared motor (not shown). When this geared motor is put into action, the endless belts 16 are moved in the direction of the arrows F1 in FIG. 1, driving with them the pressing cylinder 10, as illustrated by arrow F2.

In the part of the pressing cylinder 10 which is not in contact with the endless belts 16, a presenting device 22 facilitates the insertion of items of washing to be pressed (not shown) between the endless belts 16 and the cylinder 10, so that the items of washing are automatically carried between these components in order to be pressed.

In order to ensure effective pressing of the washing, the cylinder 10 is internally heated by heating means (not shown) generally electrically or with gas, and it is externally covered by a molleton (not shown).

Conforming to the invention, the rotating pressing cylinder 10 is made of stainless steel and is produced by flow-spinning, from a hollow cylindrical blank of stainless steel, of small length and large thickness.

It will be recalled that the technique of flow spinning consists of placing a blank on a rotatably driven mandrel and of pressing against the material by means of rollers, in order to cause it to flow along the mandrel, in successive passes.

This manufacturing technique allows the pressing cylinder 10 to be produced in one piece and without any welding. Furthermore, its use permits a reduction in the thickness of the cylinder and appreciably lower values to those for existing pressing cylinders, produced from a flat plate by being bent and then welded. Hence and only by way of example, in the case of a pressing cylinder having an external diameter of about 325 mm, this cylinder can be given a thickness of about 2.3 mm.

In a more general way, the technique of flow spinning used to manufacture the pressing cylinder according to the invention allows a ratio between the thickness of the cylinder and its external diameter to be given a value between $1/180$ and $1/280$ according to the diameter.

The production or the pressing cylinder in stainless steel permits use of the machine in any atmosphere and notably in the presence of saline air.

Furthermore, the thinning down of the pressing cylinder compared with the cylinders that are fitted to existing machines provides a benefit in relation to mass that is sufficient to allow the chassis 20 of the machine to be made lighter as well as the mechanical parts including the rollers 12, through which the cylinder is supported on the chassis 20.

Hence, as has been shown in FIG. 2, each of the cambered rollers 12 is made preferably in a non-metallic material such as a composite material that includes glass fiber reinforcement in a matrix of epoxy, polyaramide or some other resin.

Each of the cambered rollers 12 is directly mounted on a fixed spindle 24, by means of one or two ball bearings 26 of small size. As is illustrated in FIG. 2, each of the fixed spindles 24 is fixed directly onto a part of the chassis 20 of the drying-pressing machine situated beyond the adjacent extremity of the pressing cylinder 10. The fixing can be carried out by any appropriate means and notably with the aid of a nut 28, screwed onto a threaded part of the spindle 24.

The use of cambered non-metal rollers 12 enables the noise to be substantially reduced compared with existing machines and reduces to a large degree the wearing of the rollers and the parts of the cylinder 10 in contact with them. The reliability of the machine is found to increase.

It may be easily understood that making the pressing cylinder 10 and the rollers 12 that support it lighter enables the chassis 20 to be given a more simple structure. The sum total of these measures leads to an appreciable reduction in the cost of the machine.

Moreover, the reduction in the thickness of the pressing cylinder, made possible by the use of the flow spinning technique, allows the cylinder to react more rapidly to temperature variations, during operation of the machine. This translates into greater flexibility in operation and, as a consequence, more flexible use of the drying-pressing machine.

The technique of flow spinning used, in conformity with the invention, to manufacture the pressing cylinder 10 has, as a consequence, the formation of circumferential grooves, generally in the form of a helix, on the external surface of the cylinder. In the absence of any later machining, this characteristic translates into an increase in the surface area for exchange between the ambient air and the pressing cylinder. This accentuates still more the speed of reaction of the cylinder to temperature variations.

I claim:

1. A drying and ironing machine comprising:

a one-piece, stainless steel pressing cylinder that is internally heated and rotatable, said pressing cylinder being produced without welding by placing a hollow cylindrical blank of stainless steel on a rotating mandrel and pressing said blank against said mandrel in successive passes using rollers, thereby causing the blank to flow along the mandrel; and an endless belt in contact with an external surface of said pressing cylinder such that items of linen may be received between the endless belt and the pressing cylinder.

2. A drying and ironing machine according to claim 1, wherein the ratio between the thickness of the pressing cylinder and its external diameter is between 1/180 and 1/280 according to the diameter.

3. A drying and ironing machine according to claim 1, wherein the pressing cylinder has circumferential grooves on an external surface.

4. A drying and ironing machine according to claim 1, wherein the pressing cylinder rests on cambered rollers made of a non-metallic material.

5. A drying and ironing machine according to claim 4, wherein the cambered rollers are made from a composite material including a glass fiber reinforcement and a resin matrix.

6. A drying and ironing machine according to claim 4, wherein each of the cambered rollers is mounted on a fixed spindle using at least one ball bearing.

7. A process comprising manufacturing a pressing cylinder adapted for use in a drying and ironing machine having an endless belt, wherein the pressing cylinder is internally heated and rotatable and has an external surface in contact with said endless belt, said process including the steps of:

providing a hollow cylindrical blank composed of stainless steel;

providing a mandrel;

placing the blank on the mandrel;

rotating the mandrel; and pressing the blank against the mandrel in successive passes using rollers, thereby causing the blank to flow along the mandrel and form the pressing cylinder in one piece, without welding.

* * * * *

UNITED STATES PATENT AND TRADEMARK OFFICE

CERTIFICATE OF CORRECTION

PATENT NO. : 5,983,522

DATED : November 16, 1999

INVENTOR(S) : Adler

It is certified that error appears in the above-indentified patent and that said Letters Patent is hereby corrected as shown below:

Column 3, Line 29, delete "16" and insert --18--.

Column 4, Line 4, delete "or" and insert --of--.

Signed and Sealed this

Eleventh Day of July, 2000

*Attest:*

Q. TODD DICKINSON

*Attesting Officer*

*Director of Patents and Trademarks*